US007753480B2

(12) United States Patent
Ueda et al.

(10) Patent No.: US 7,753,480 B2
(45) Date of Patent: Jul. 13, 2010

(54) IMAGE FORMING APPARATUS AND IMAGE SCANNER

(75) Inventors: Kiyoshi Ueda, Anjo (JP); Yukio Shiohara, Nagoya (JP); Hiroaki Yazawa, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 279 days.

(21) Appl. No.: 10/831,115

(22) Filed: Apr. 26, 2004

(65) Prior Publication Data

US 2005/0001875 A1 Jan. 6, 2005

(30) Foreign Application Priority Data

Apr. 25, 2003 (JP) ..... 2003-122335

(51) Int. Cl.
*B41J 23/00* (2006.01)

(52) U.S. Cl. ..... 347/37

(58) Field of Classification Search ..... 347/37; 384/137; 400/354

See application file for complete search history.

(56) References Cited

U.S. PATENT DOCUMENTS

| | | | | |
|---|---|---|---|---|
| 4,054,330 | A * | 10/1977 | Luo | 384/53 |
| 4,714,354 | A * | 12/1987 | Satomi | 384/38 |
| 4,951,599 | A * | 8/1990 | Damji | 399/90 |
| 5,065,169 | A * | 11/1991 | Vincent et al. | 347/8 |
| 5,366,305 | A | 11/1994 | Christianson | |
| 5,403,154 | A * | 4/1995 | Ide | 415/229 |
| 5,667,310 | A * | 9/1997 | Oyagi et al. | 384/137 |
| 6,450,710 | B1 * | 9/2002 | Foster et al. | 400/58 |
| 6,511,227 | B1 * | 1/2003 | Siow et al. | 384/428 |
| 6,524,021 | B2 * | 2/2003 | Johnson et al. | 400/354 |
| 6,575,646 | B1 * | 6/2003 | Guillen et al. | 400/354 |
| 6,789,966 | B2 * | 9/2004 | Tanaka et al. | 400/354 |
| 6,932,457 | B2 * | 8/2005 | Sato | 347/37 |
| 6,974,203 | B2 * | 12/2005 | Ikeda et al. | 347/37 |
| 2003/0031392 | A1 * | 2/2003 | Ishii | 384/448 |
| 2004/0091298 | A1 * | 5/2004 | Nellen | 400/354 |

FOREIGN PATENT DOCUMENTS

| | | |
|---|---|---|
| JP | A 56-15383 | 2/1981 |
| JP | A 61-158349 | 7/1986 |
| JP | A 6-79944 | 3/1994 |
| JP | A 06-219013 | 8/1994 |
| JP | A 7-19246 | 1/1995 |
| JP | B2 3009787 | 12/1999 |

* cited by examiner

*Primary Examiner*—Julian D Huffman
*Assistant Examiner*—Jason S Uhlenhake
(74) *Attorney, Agent, or Firm*—Oliff & Berridge, PLC

(57) ABSTRACT

An image forming apparatus includes: a recording head that forms an image onto a recording medium; a guide shaft disposed to extend in a direction orthogonal to a conveyance direction of the recording medium; a carriage on which the recording head is mounted and includes a support portion formed integrally with the carriage; and a bearing unit attached to an inner surface of the support portion and allows the carriage to be moved along the guide shaft, and includes plate-shaped bearing portions that are disposed to have a contained angle that allows the bearing portions to contact with a circumferential surface of the guide shaft at two points.

30 Claims, 14 Drawing Sheets

IMAGE FORMING APPARATUS AND IMAGE SCANNER

BACKGROUND OF THE INVENTION

1. Field of the Invention

The present invention relates to an image forming apparatus such as printers, facsimile machines or copying machines, and particularly relates to the configuration of a support unit for supporting a carriage with respect to a guide shaft.

2. Description of the Related Art

In the background art, in order to move a carriage mounted with a recording head for use in a low-priced printer or the like forward and backward in a main scanning direction, a guide shaft having a circular shape in section is fixedly disposed in parallel with the main scanning direction, while a carriage bearing portion having a hole diameter slightly larger than the diameter of the guide shaft is formed integrally with the carriage made from synthetic resin, and the guide shaft is inserted into the bearing portion so as to support the carriage slidably thereon.

In the aforementioned configuration, however, due to the hole diameter of the carriage bearing portion slightly larger than the diameter of the guide shaft, there is a problem that looseness occurs between the hole of the carriage bearing portion and the guide shaft so that the position of the carriage bearing portion with respect to the guide shaft is not settled. Particularly, when the carriage is rotated and adjusted around the guide shaft so as to adjust the size of a gap between the recording head on the carriage and a recording medium on a platen, the gap does not change in proportion to the rotation angle of the carriage. Thus, there is a problem that the gap adjustment becomes unstable.

In order to solve the foregoing problems, JP-A-6-079944 discloses a configuration where a carriage bearing having a substantially U-lettered shape in sectional view and a plate spring to which a sliding member having a substantially triangular shape in section is attached at its front end are provided on a carriage, and two surfaces of the substantially U-lettered shape of the carriage bearing contact with the circumferential surface of a guide shaft while the guide shaft is held by the sliding member on the opposite side to the carriage bearing.

On the other hand, JP-A-7-019246 discloses a configuration where a sliding bearing including a generally planar body structure made from a thin and flat bronze sheet material is incorporated integrally on the opposite sides of a synthetic resin carriage assembly (carriage body) by insert molding. A through hole of the sliding bearing is formed into a piriform shape having two contact surfaces which are substantially flat surfaces. The contact surfaces are provided in positions of about one-thirty and ten-thirty in the upper portion of the though hole and separated from each other in the form of symmetric bows. The diameter of the lower side of the through hole is formed to be slightly larger than the diameter of a guide shaft. Thus, the two contact surfaces in the upper portion of the through hole have two linear contacts at two points on the circumferential surface of the guide shaft.

SUMMARY OF THE INVENTION

Generally, the body of the carriage is molded integrally out of a synthetic resin material complying with rigidity and strength required therefor.

In JP-A-6-079944, however, the carriage bearing having a substantially U-lettered shape in side view is formed integrally with the carriage body made from synthetic resin.

Therefore, requirements of such as an abrasion resistance and a low frictional coefficient for carriage bearing portions thereof may be not satisfied. Particularly when a composite material having glass short fibers or glass microspheres mixed into a synthetic resin material is adopted to enhance the rigidity and strength of the carriage body, the glass fibers or the glass microspheres are exposed in the surface where the carriage bearing slides on the guide shaft. Thus, with the movement of the carriage in the main scanning direction, the glass fibers or the glass microspheres injure the circumferential surface of the guide shaft generally made from metal so that the guide shaft is apt to wear down. In addition, since the bearing surfaces of the U-lettered shape have two linear contacts, there is another problem that the roundness of the guide shaft is damaged largely due to variation of such wear with time.

On the other hand, in JP-A-7-019246, the sliding bearing having a piriform through hole is insert-molded separately at the same time that the carriage body is molded. There is therefore a problem that only a defective sliding bearing cannot be replaced in the case where there occurs an attachment error in the sliding bearing when two sliding bearings are disposed and insert-molded at a distance from each other in the axial direction of the guide shaft or in the case where the sliding bearing has worn due to long-term use.

The present invention was developed mainly to solve the foregoing problems, and one of the object of the present invention is to provide an image forming apparatus and an image scanner in which bearing units for a guide shaft are formed separately from a carriage body and attached to a support portion of the carriage body, so that the positional accuracy of bearing portions with respect to the guide shaft is improved and the durability is enhanced.

In order to achieve the above object, according to a first aspect of the invention, there is provided an image forming apparatus including: a recording head that forms an image onto a recording medium; a guide shaft disposed to extend in a direction orthogonal to a conveyance direction of the recording medium; a carriage on which the recording head is mounted and includes a support portion formed integrally with the carriage; and a bearing unit attached to an inner surface of the support portion and allows the carriage to be moved along the guide shaft, and includes plate-shaped bearing portions that are disposed to have a contained angle that allows the bearing portions to contact with a circumferential surface of the guide shaft at two points.

According to a second aspect of the invention, there is provided an image scanner including: a scanning head that scans an image formed on a medium to be scanned; a guide shaft disposed to extend in a direction orthogonal to a conveyance direction of the medium; a carriage on which the scanning head is mounted and includes a support portion formed integrally with the carriage; and a bearing unit attached to an inner surface of the support portion and allows the carriage to be moved along the guide shaft, and includes plate-shaped bearing portions that are disposed to have a contained angle that allows the bearing portions to contact with a circumferential surface of the guide shaft at two points.

BRIEF DESCRIPTION OF THE DRAWINGS

A preferred embodiment of the present invention will be described in detail with reference to the following accompanying drawings, in which.

DETAILED DESCRIPTION OF THE PREFERRED EMBODIMENTS

Referring now to the accompanying drawings, a description will be given in detail of preferred embodiments of the invention.

Figure 1:
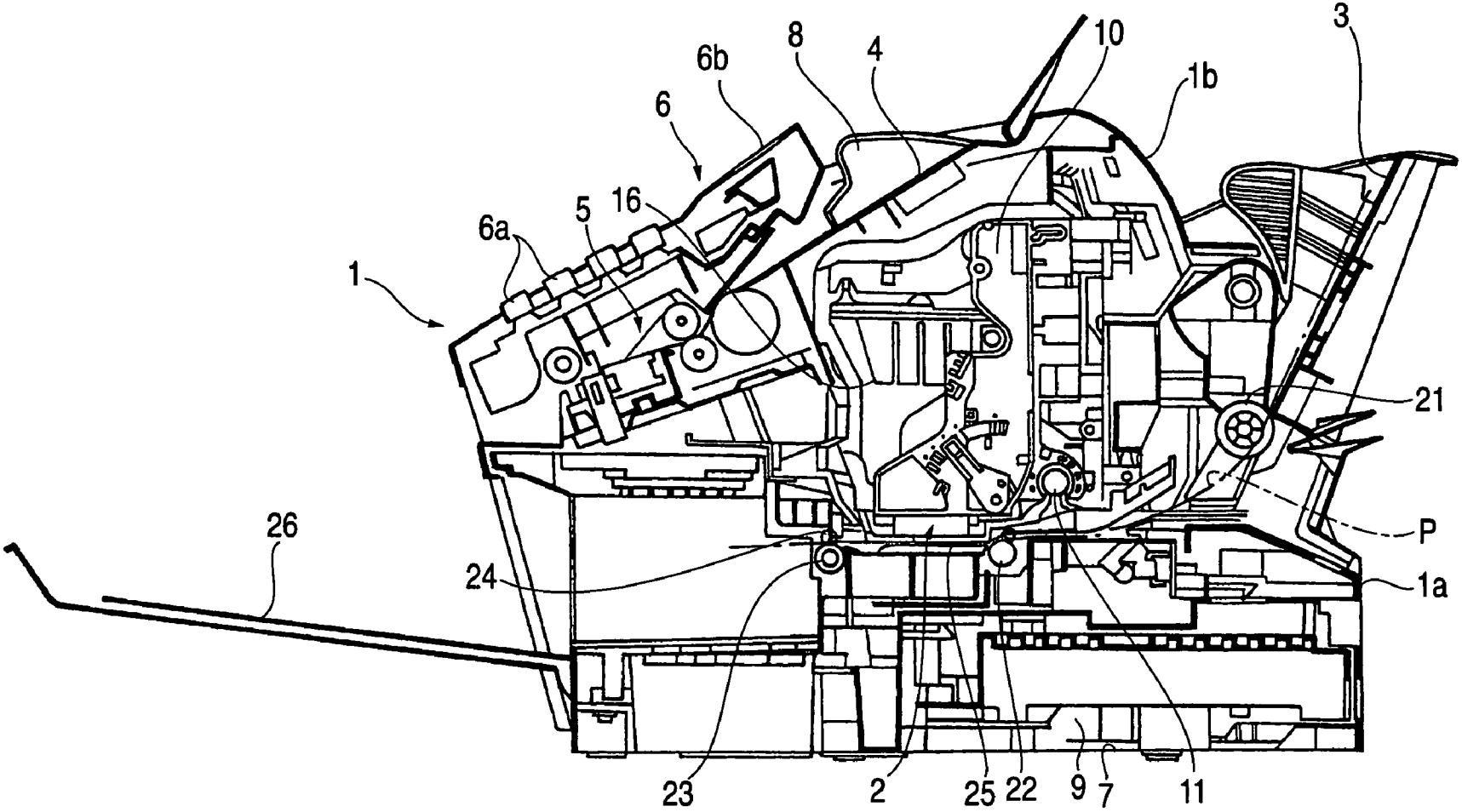
FIG. 1 is a schematic side sectional view of multifunctional apparatus.
Figure 2:
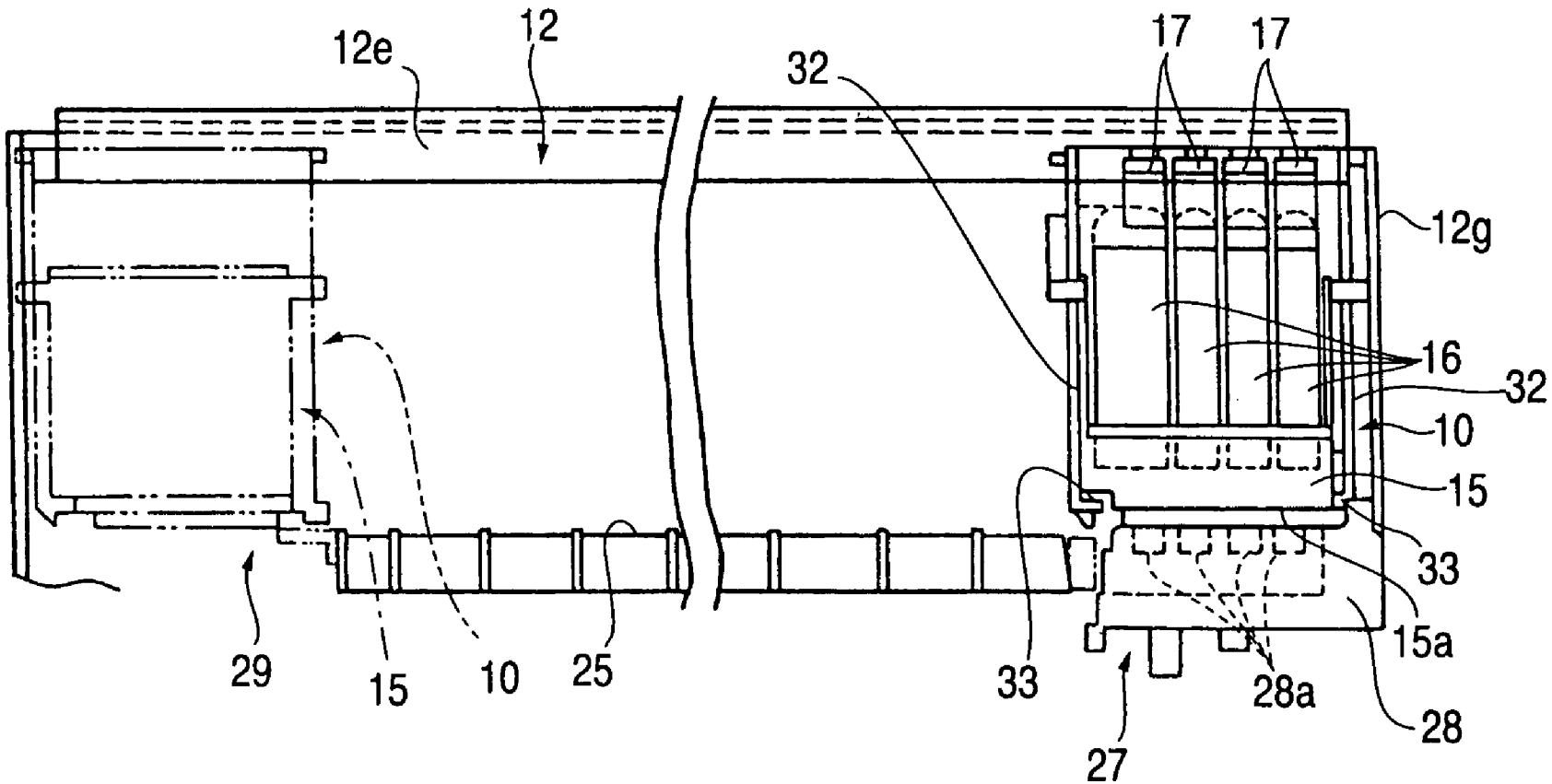
FIG. 2 is a schematic front view showing the state where a carriage moves to left/right with respect to a frame.

A body casing of the multifunctional apparatus 1 is constituted by a main lower casing 1*a* made from synthetic resin and an upper casing 1*b* made from synthetic resin as shown in FIGS. 1 and 2. The main lower casing 1*a* receives an inkjet recording portion 2 and includes a paper feed tray 3 tilting upward on the rear side. The paper feed tray 3 is provided for supplying sheet P for forming an image thereon. The upper casing 1*b* covers the upper side of the main lower casing 1*a*.

A sheet mounting portion 4 is disposed in a portion close to the rear top of the upper casing 1*b*, and a sheet reading unit 5 as a sheet reading portion is attached to a portion close to the front of the sheet mounting portion 4. The upper side of the sheet reading unit 5 is covered with an operation panel 6. An operation key portion 6*a* including various function keys and a ten key pad, and a display portion 6*b* such as a liquid crystal panel capable of displaying values inputted from the operation key portion 6*a* or various characters or digits for operation are provided in the surface of the operation panel 6. A pair of left and right sheet guide plates 8 sliding to left and right in accordance with the width of a sheet to be conveyed are attached to the sheet mounting portion 4 so as to guide the opposite, left and right side edges of the sheet.

Incidentally, the lower surface of the main lower casing 1*a* is closed with a bottom cover plate 7 made from a metal plate or the like. A control portion 9 is disposed in an internal space of the main lower casing 1*a*. Though not shown, the control portion 9 includes a control board, a power supply board, an NCU (Network Control Unit) board for opening the way for conversation with other telephone sets or transmission/reception of facsimile data with other facsimile machines through a phone line, and so on. Further, though not shown, a handset for conversation with another telephone set is mounted on a cradle provided to project outward from a side portion of the main lower casing 1*a*. In addition, a speaker for calling and monitoring is fixed to the rear side of the right side surface or the like in the main lower casing 1*a*.

Figure 3:
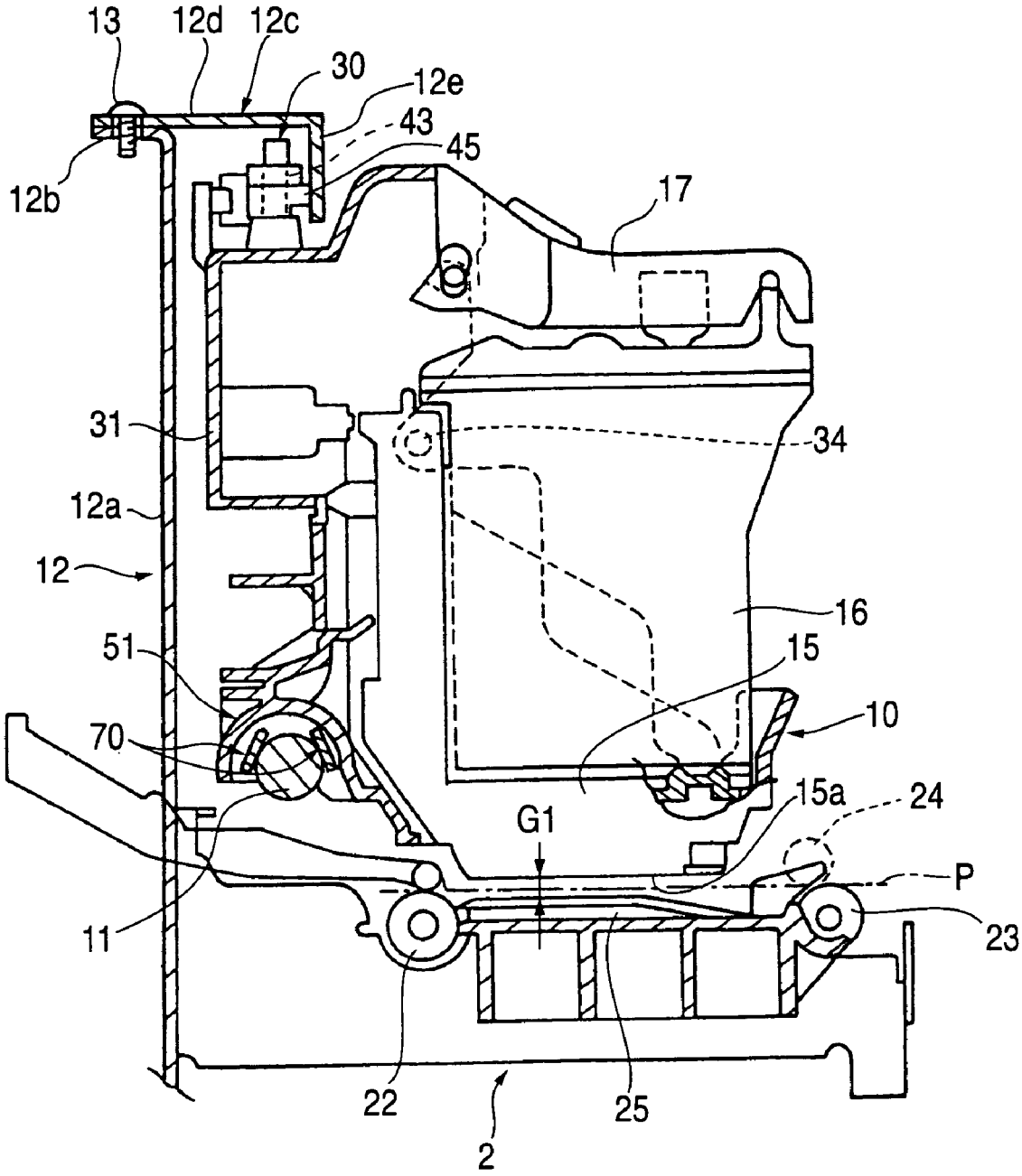
FIG. 3 is a side sectional view of the carriage mounted with the frame and a recording head.

As shown in FIG. 3, in the recording portion 2, a guide shaft 11 like a round shaft is attached to the surface (front) side of the lower portion of an upright frame 12 which is longer horizontally. On the other hand, four bearing units 70 which will be described later are attached to support portions 51 so as to form inverted V lettered shapes in side view respectively. The support portions 51 are formed integrally on the opposite, left and right end sides of the back-side lower portion of the carriage 10. The bearing units 70 are brought into contact with the circumferential surface of the guide shaft 11 so as to mount the carriage 10 on the guide shaft 11 slidably in the main scanning direction and rotatably around the guide shaft 11.

Figure 4:
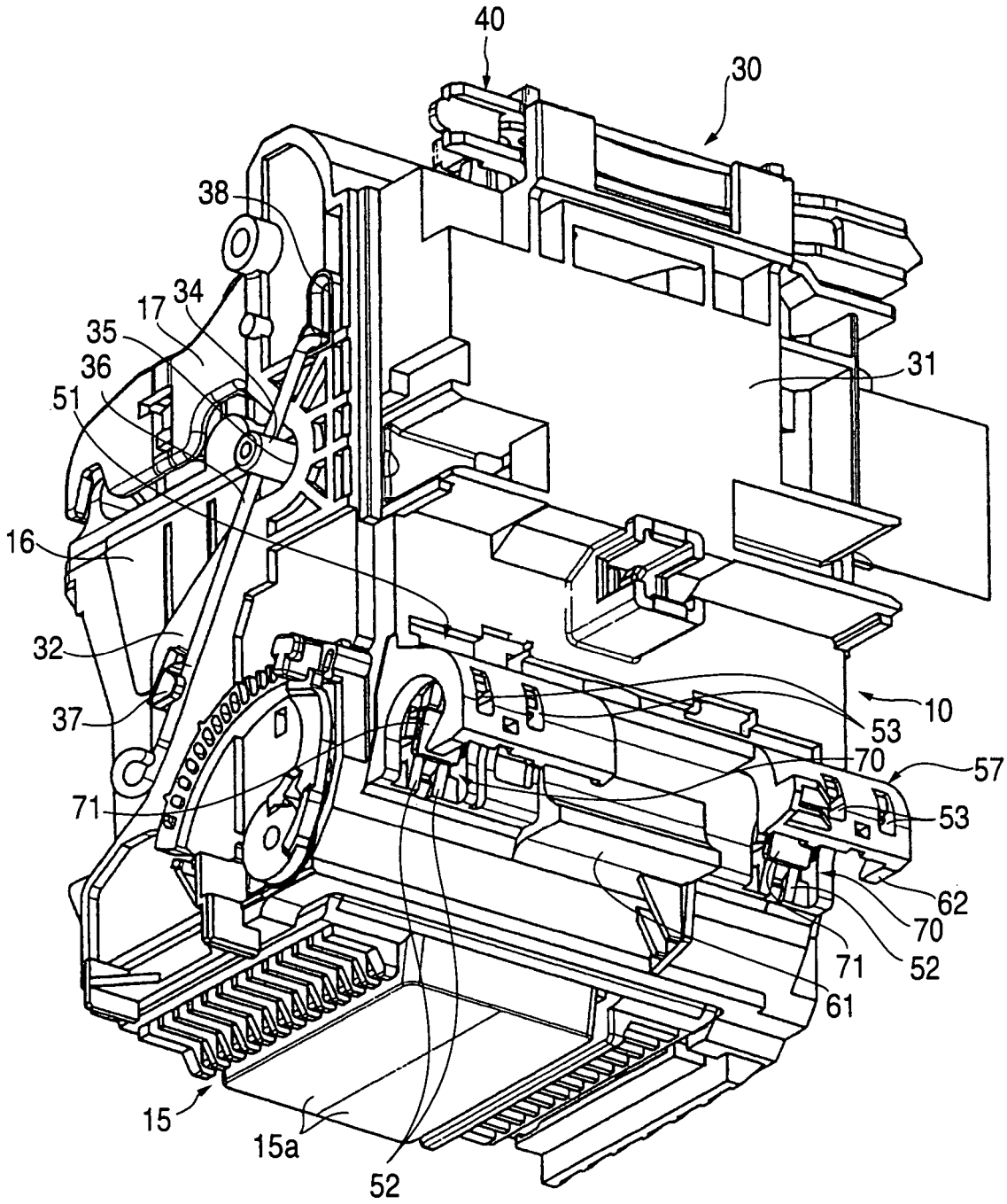
FIG. 4 is a back perspective view of the carriage mounted with the recording head and ink cartridges, showing the portion where bearing units have been attached to support portions.

A color inkjet cartridge type recording head 15 shown in FIGS. 2 through 4 is removably attached to the carriage 10 to face downward. The recording head 15 for performing color recording includes four nozzle portions 15*a* on its bottom side. The nozzle portions 15*a* are provided for ejecting inks of colors of cyan, yellow, magenta and black respectively. Ink cartridges 16 for the respective colors can be removably mounted on the top side of the recording head 15 as shown in FIG. 2. The inks to be supplied to the recording head 15 have been received in the ink cartridges 16. The ink cartridges 16 can be pressed downward and fixed respectively by pressure levers 17 which can rotate up and down facing forward on the upper end side of the carriage 10.

Figure 6:
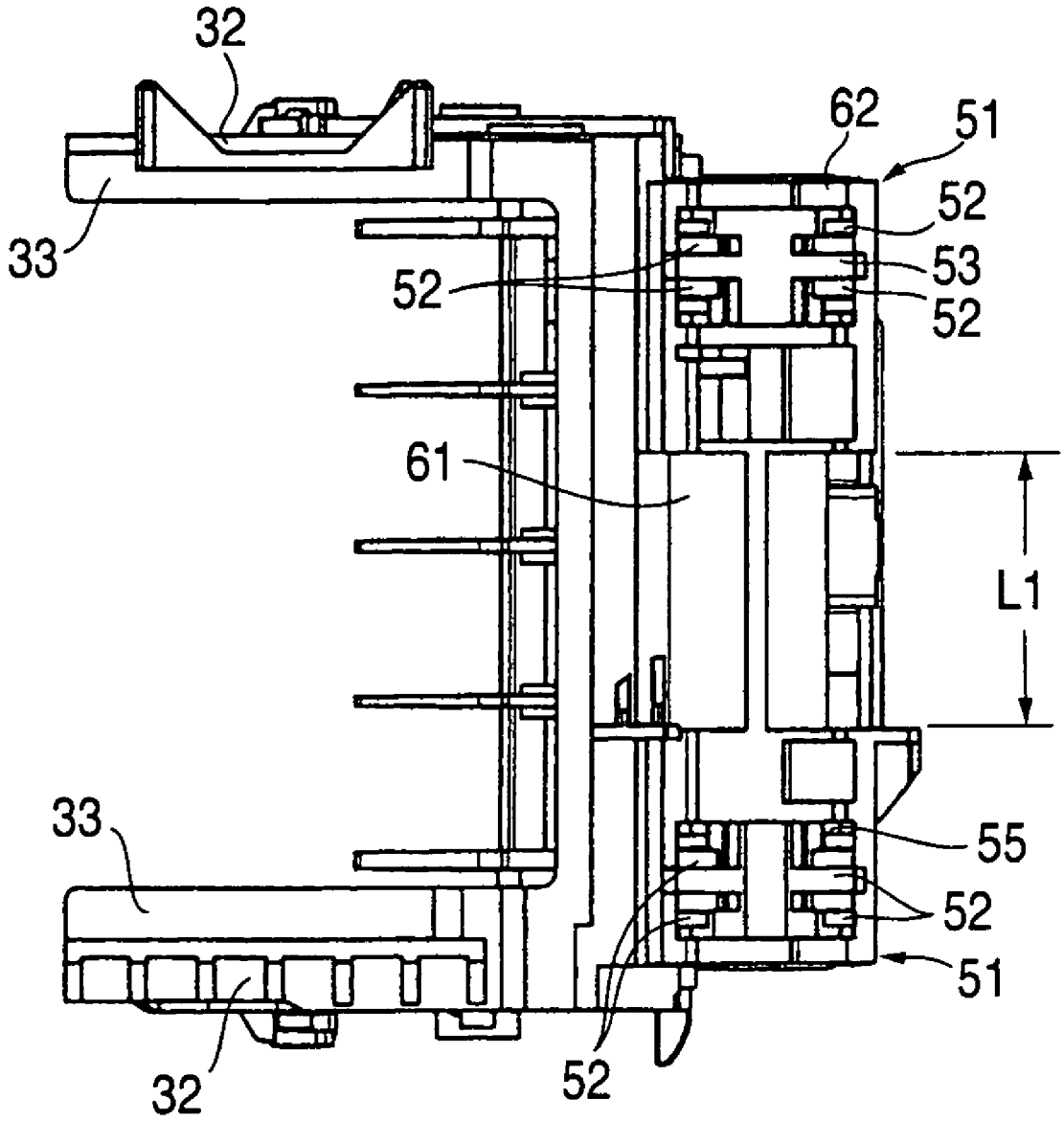
FIG. 6 is a bottom view of the carriage in which the bearing units have not yet been attached to the support portions.

In addition, a timing belt (not shown) extending in parallel with the guide shaft 11 is wound on a driven pulley (not shown) and a driving pulley (not shown). The driven pulley is disposed closely to one side of the frame 12, and the driving pulley is fixed to the output shaft of a drive motor (not shown) such as a stepping motor which can rotate forward and backward. The timing belt is coupled at one place with the carriage 10 so that the carriage 10 can move forward and backward in the longitudinal direction of the guide shaft 11 (main scanning direction). Incidentally, sheets of the sheet P stacked on the paper feed tray 3 are separated one by one by a paper feed roller 21 (see FIG. 1) and a separation unit. The paper feed roller 21 serves as a paper feed mechanism with a structure known well conventionally and is disposed in the rear portion of the main lower casing 1*a*. The separation unit is constituted by a separation pad, a frictional separation plate or the like. The front end position of the separated sheet P is once adjusted by a registration roller 22 for adjusting the timing of the front end of the sheet P. After that, the sheet P is fed between the bottom of the recording head 15 and a platen 25. While the sheet P is conveyed in a sub-scanning direction between a pair of upper and lower conveyance rollers 23 and 24 on the downstream side of conveyance, ink droplets are ejected onto the upper surface of the sheet P in accordance with a print instruction so as to record an image thereon. After that, the sheet P is discharged to a delivery tray 26 (see FIGS. 1 and 6).

Next, description will be made on the printing operation by the carriage 10 with reference to FIG. 2. A maintenance portion 27 having a maintenance mechanism is disposed out of the recording area and near a moving end of the carriage 10, for example, on the right side of the platen 25. A nozzle wiping unit (wiper unit) for wiping ink droplets adhering to the surfaces (face surfaces) of the nozzle portions 15*a* of the recording head 15, and a purging unit (nozzle suction unit) 28 for recovering the recording head 15 from non-ejection of ink or failure in ejection of ink are disposed in the maintenance portion 27. In the purging unit 28, the nozzle portions of the recording head 15 are covered with suction caps 28*a*, and defective ink in the recording head 15 is sucked due to negative pressure generated by a not-shown pump so that the recording head 15 is recovered from failure in recording. Incidentally, the purging unit 28 in the maintenance portion 27 is located in a home position (right end position in FIG. 2) of the moving end portion of the carriage 10. The purging unit 28 also serves as a capping mechanism (protective device) for covering all the nozzle portions 15*a* of the recording head 15 on the carriage 10 so as to prevent ink from being evaporated, and each suction cap 28*a* also has a function of a protective cap.

Incidentally, according to a known technique, though not illustrated in detail here, the suction caps 28*a* of the maintenance portion 27 are designed to be movable vertically in FIG. 2 so as to cover all the nozzle portions 15*a* of the recording head 15. When the suction caps 28*a* move upward to cover the nozzle portions 15*a*, the suction caps 28*a* are pressed onto the surface provided with the nozzle portions 15*a* by a certain force. Thus, the bearing units 70 disposed on the support portions 51 of the carriage 10 are lifted up from the guide shaft 11. In the following description, the reference numeral 28 designating the purging unit will be also used as the reference numeral designating the home position. In addition, a flushing portion 29 for ejecting ink from each nozzle portion 15*a* of the recording head 15 tentatively so as to prevent ink clogging is provided in the left end of the platen 25.

In accordance with various instructions inputted from the operator through various key operations in the operation panel portion 6, the multifunctional apparatus 1 described above has not only a normal facsimile function of setting various processing operations, reading a sheet image using the sheet reading unit 5, converting the sheet image into data to be transmitted, encoding the data to be transmitted, transmitting and receiving facsimile data transmitted to and from another facsimile machine through a communication line such as a phone line, decoding received data, and recording the decoded facsimile data onto sheet P in the recording unit, but also a copying machine processing function of reading a sheet using a CIS (Contact Image Sensor) of the sheet reading unit 5 and forming a color image onto the sheet P by means of respective units of the recording portion, a printer processing function of forming a color image on the sheet P in accordance with print data transmitted from not-shown external apparatus such as a personal computer (host computer) through a printer cable or by wireless using infrared light or the like, and a scanner processing function of transmitting the image data read by the sheet reading unit 5 to the external apparatus.

Incidentally, a changeover mechanism 30 is provided in the top rear end portion of the carriage 10. The changeover mechanism 30 performs the formation of a gap between the face surface of the recording head 15 and the sheet P and the adjustment of the size of the gap having influence on the printing quality In the gap changeover mechanism 30, a pair of pivots 43 (only one of which is shown in FIG. 3) are provided to be erect upward in the rear end portion of the top of the carriage 10. Guide pieces (not shown) are rotatably fitted to the pivots 54 respectively. Each guide piece is linked through a not-shown pivotal support portion to a changeover link piece 40 longer in the moving direction of the carriage 10, so that the guide piece can rotate horizontally relatively to the changeover link piece 40. A first contacting portion (not shown) made from synthetic resin and having a block-like shape is provided to project in the substantially central portion of the rear end portion of the top of the carriage 10, while a second contacting portion 45 is provided in a side portion of each guide piece. The second contacting portion 45 is set to be higher in height in the direction toward a vertical rail portion 12*e*, which will be described later, while the first contacting portion is set to be lower in height in the direction toward the vertical rail portion 12*e*.

On the other hand, the frame 12 has a longitudinal plate portion 12*a*, a horizontal support portion 12*b* and a rail portion 12*c* as shown in FIG. 3. The longitudinal plate portion 12*a* is provided erectly substantially in parallel with a back plate 31 of the carriage 10. The horizontal support portion 12*b* is formed by bending the upper end of the longitudinal plate portion 12*a* rearward (on the opposite side to the portion where the carriage 10 is disposed). The rail portion 12*c* serves as a bent sliding member to be put on the top of the horizontal support portion 12*b* and linked thereto by a screw 13. The rail portion 12*c* is formed into an L-lettered shape in section, having a horizontal portion 12*d* extending forward and a vertical rail portion 12*e* formed by bending the front end of the horizontal portion 12*d* downward. The vertical rail portion 12*e* in the rail portion 12*c* faces the rear end portion of the top of the carriage 10. The position where the horizontal portion 12*d* is attached to the horizontal support portion 12*b* of the frame 12 is adjusted so that the distance between the longitudinal plate portion 12*a* and the vertical rail portion 12*e* can be finely adjusted. Thus, the first contacting portion or the second contacting portion 45 selectively contacts with the inner surface of the vertical rail portion 12*e* so that the size of a gap (G1) between the lower surface of each nozzle portion 15*a* of the recording head 15 and the platen 25 can be changed over.

Next, description will be made on means for preventing the bearing units in the carriage 10 or the guide shaft 11 to fall away, while supporting the carriage 10 on the guide shaft 11 slidably in the axial direction thereof and rotatably around the axis thereof.

Figure 5:
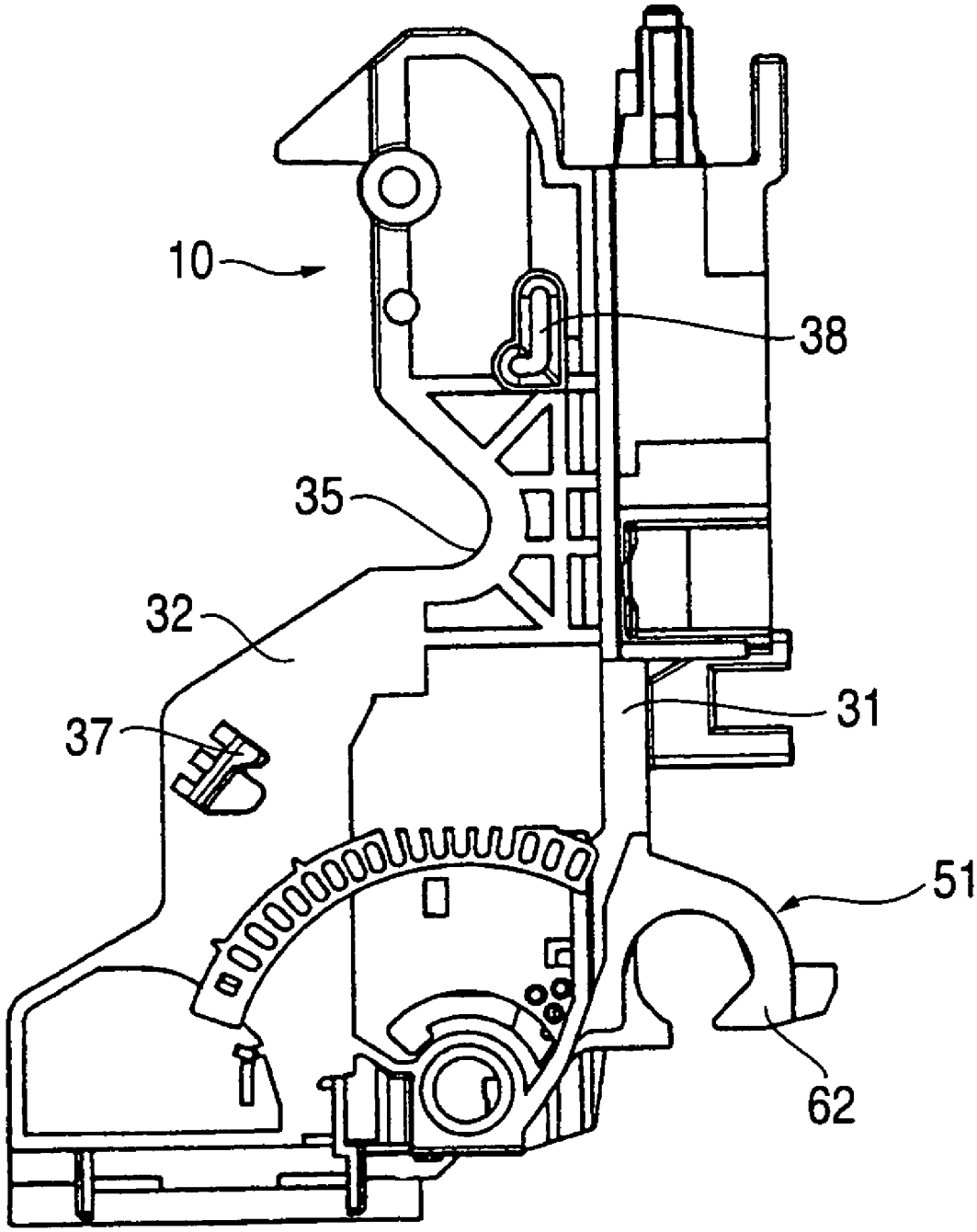
FIG. 5 is a right side view of the carriage in which the bearing units have not yet been attached to the support portions.

FIGS. 4-7, 8A-8D, 9, 10A-10B, 11A-11B, 12A-12B, and 13-14 show a first embodiment. First, description will be made on the configuration of the carriage 10 according to the first embodiment. The carriage 10 is an injection-molded piece made from synthetic resin (such as epoxy resin) containing glass short fibers or glass hollow beads. Opposite, left and right side plates 32 project forward from the opposite, left and right sides of a back plate 31 while a pair of support portions 33 for supporting the opposite, left and right sides of the bottom plate of the recording head 15 are provided to project inward from the lower end portions of the side plates 32, respectively. The nozzle portions 15*a* of the recording head 15 are disposed to be exposed downward between the opposite support portions 33 (see FIGS. 3, 5 and 6). Engagement pins 34 (only one of which is shown in FIG. 4) projects outward from the opposite, left and right sides of the recording head 15 disposed between the opposite, left and right side plates 32. The engagement pins 34 are disposed in recesses 35 formed as depressions in the opposite, left and right side plates 32, respectively. The engagement pins 34 are pressed downward obliquely in the longitudinally middle portions of wire springs 36 (only one of which is shown in FIG. 4) having elasticity, respectively. The wire springs 36 are made from metal or the like, and rotatably attached to mounting holes 38 on the outside upper ends of the opposite, left and right side plates 32, respectively. On the other hand, the lower ends (free ends) of the wire springs 36 are locked in obliquely downward hook-like lock portions 37 so as to be prevented from moving upward and from falling out of the side plates 32 accidentally. The lock portions 37 are formed to project outside the side plates 32, respectively. Thus, the recording head 15 is attached to the carriage 10 firmly and without looseness.

Each support portion 51 has a substantially circular arc shape open in its bottom in side view. The support portions 51 are formed integrally with the opposite, left and right sides of a portion of the back plate 31 of the carriage 10 close to its lower portion, so as to be separated at a proper distance (L1 in this embodiment, see FIGS. 7 and 10A) in the main scanning direction and placed in a linear relationship (see FIGS. 4-7, 9, 10A-10B, 11A-11B, 12A-12B and 13-14). In addition, a retaining portion 61 for preventing the guide shaft 11 from falling off downward is formed integrally with the substantially width-direction central portion of the carriage between the left and right support portions 51 and 51 so as to project rearward from the back plate 31 (see FIGS. 4 through 7). Further, closely to the opposite, left and right side plates 32 of the carriage 10, second retaining portions 62 are integrally with the side ends of the left and right support portions 51 and 51. Incidentally, the first retaining portion 61 is formed continuously to be longer in the axial direction of the guide shaft 11 and as long as the aforementioned distance L1, and the upper surface of the first retaining portion 61 is formed into a concave curved surface so that the upper surface can approach the lower portion side of the circumference of the guide shaft 11 (see FIGS. 4, 7, 11A, and 12A-12B).

Two bearing units 70 having plate-shaped bearing portions 71 closely to the back plate 31 and far away therefrom respectively are disposed on the inner surface of each support portion 51 so that flat plate surfaces 71*a* of the bearing portions 71 have an inverted-V-lettered shape in side view. The flat plate surfaces 71*a* and 71*a* of the pair of bearing portions 71 are designed to contact with the upper portion side of the circumferential surface of the columnar guide shaft 11.

Since two bearing units 70 are disposed on the inner surface of each support portion 51, a total of four bearing units 70 are attached to the two support portions 51.

Each bearing unit 70 is formed integrally out of a synthetic resin (such as polyacetal resin) low in frictional coefficient and resistant to abrasion. The shape of each bearing unit 70 is shown in FIGS. 8A through 8D. That is, each bearing unit 70 includes a plate shaped-bearing portion 71, a pair of mounting feet 72 and a positioning foot 73. The bearing portion 71 has a rectangular shape or the like in plan view. The mounting feet 72 are formed to project from the opposite, left and right sides of the bearing portion 71 on the back surface side thereof substantially perpendicularly to the bearing portion 71. The positioning foot 73 projects obliquely on the back surface side of the bearing portion 71 from a side of the bearing portion 71 perpendicularly crossing the sides from which the pair of mounting feet 72 project. In addition, in a side opposite to the side where the positioning foot 73 projects, a substantially rectangular guide piece 74 is provided to project on the back surface side. A lock claw 72*a* is formed outward in a free end portion (lower end) of each mounting foot 72.

Figure 13:
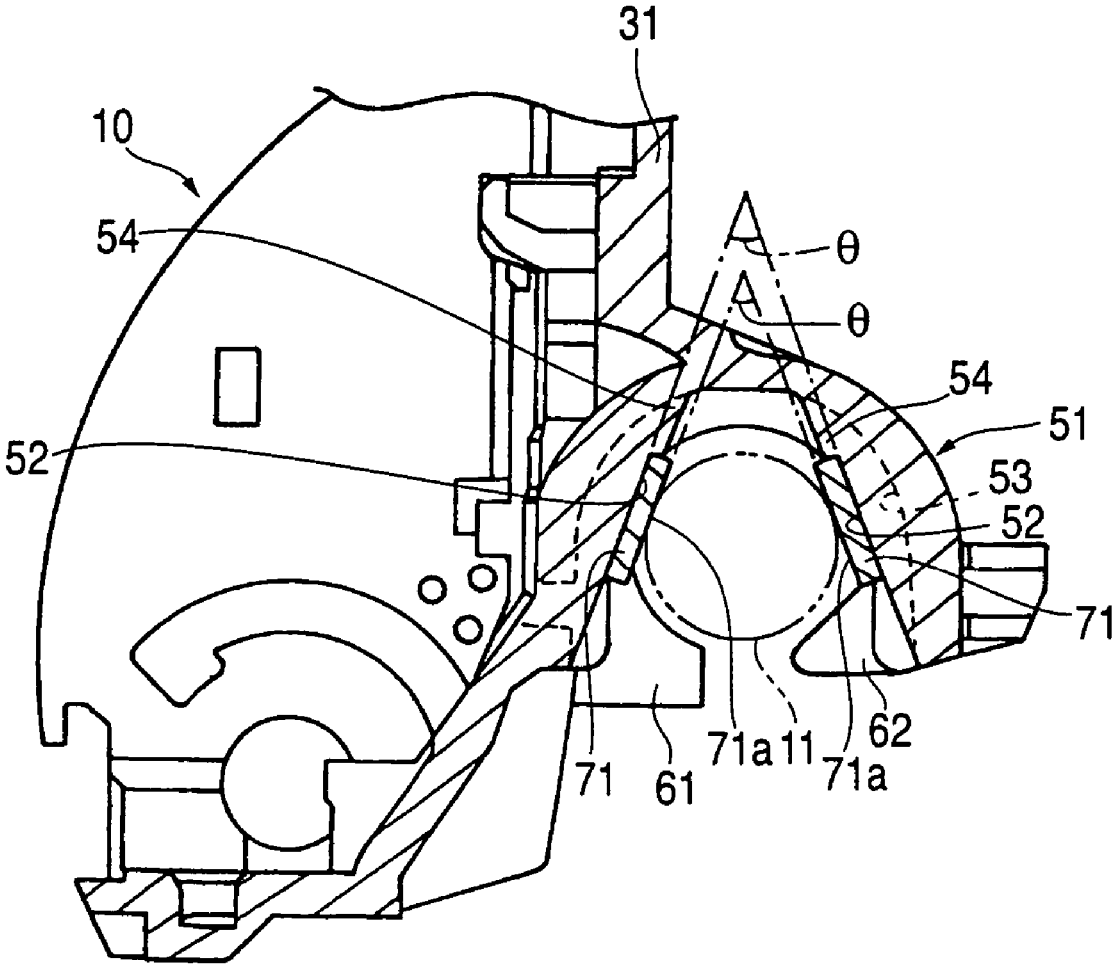
FIG. 13 is an enlarged sectional view taken on line XIII-XIII in FIG. 12A.
Figure 14:
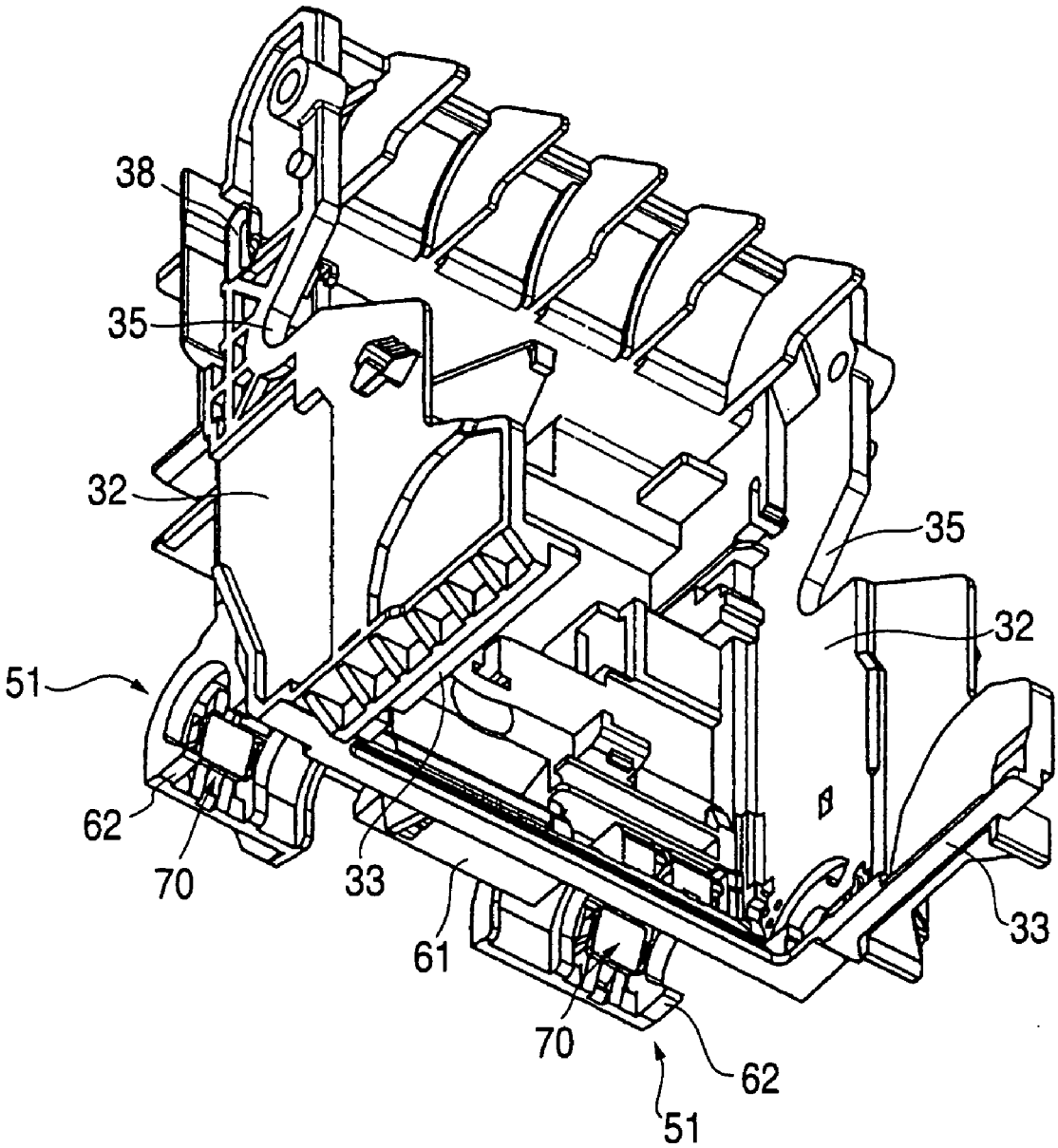
FIG. 14 is a bottom perspective view of the carriage in which the bearing units have been attached to the support portions.

The pair of bearing portions 71 in the pair of bearing units 70 disposed on the inner surface of each support portion 51 are disposed to have a contained angle θ regulated to be acute enough to allow the flat plate surfaces 71*a* to contact with the circumferential surface of the guide shaft 11 at two points. To this end, in the inner surface of each support portion 51, a pair of support surfaces 52 for supporting the back surfaces of the flat plates of the bearing portions 71 respectively are formed into an inverted-V shape with a predetermined contained angle θ (see FIG. 13). In this embodiment, as shown in FIG. 13, the contained angle θ is an acute angle smaller than 90 degrees, which is, for example, set to be in a range of from 35 degrees to 40 degrees.

As a result of experiments using the carriage 10 and the recording head 15 according to this embodiment with the contained angle θ being changed variously, it was proved that there occurred a phenomenon that the carriage 10 was lifted up from the guide shaft 11 during its accelerated motion when the contained angle θ was larger than 40 degrees. On the other hand, it was proved that the carriage 10 could not move stably due to rattling during motion when the contained angle θ was smaller than 35 degrees. Accordingly, in this embodiment, the contained angle θ is set at about 35-40 degrees, and the contained angle θ may be set properly in accordance with the configuration, weight or moving speed of the carriage 10.

Figure 7:
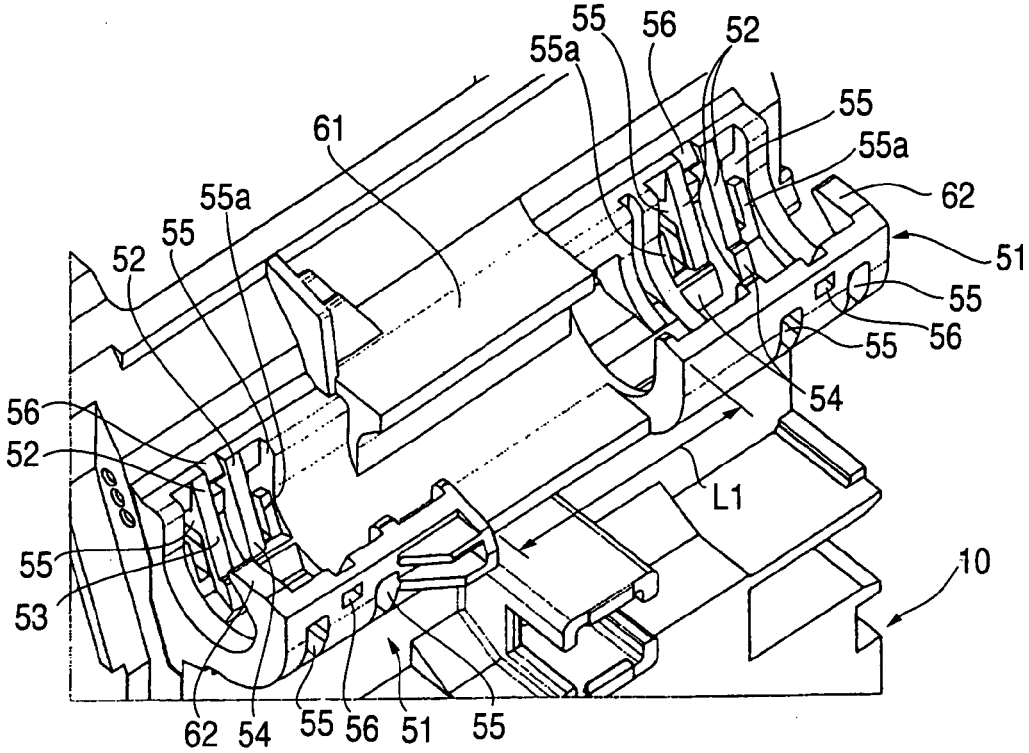
FIG. 7 is an enlarged perspective view of the support portions to which the bearing units have not yet been attached.
Figure 8A:
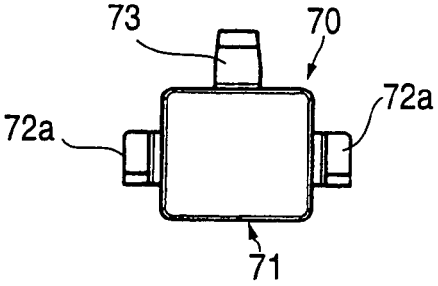
FIG. 8A is a plan view of a bearing unit.
Figure 8C:
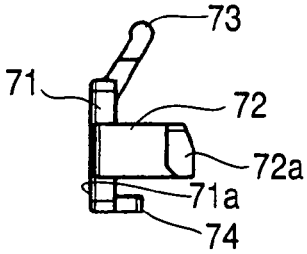
FIG. 8C is a right side view thereof.
Figure 8B:
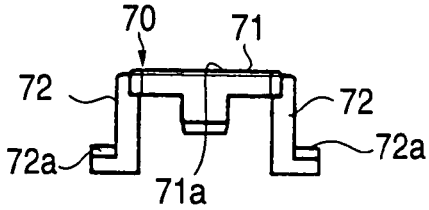
FIG. 8B is a front view thereof.
Figure 8D:
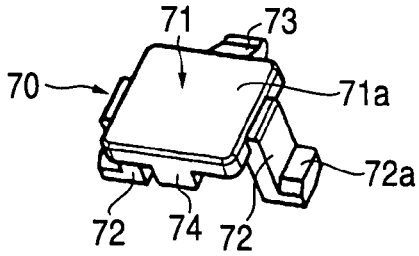
FIG. 8D is a top perspective view of the bearing unit.
Figure 9:
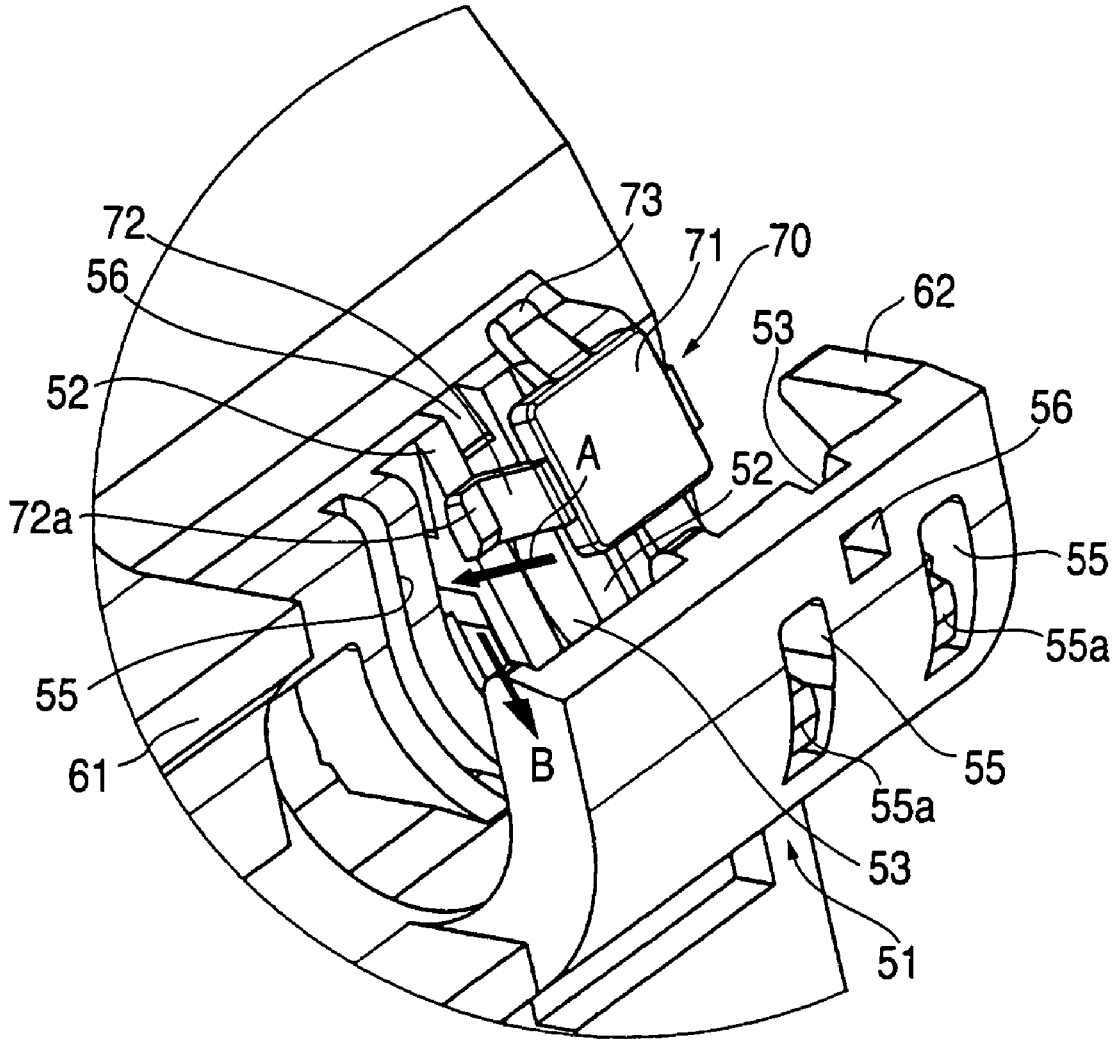
FIG. 9 is a perspective view for explaining the procedure for attaching the bearing units to the support portions.
Figure 10B:
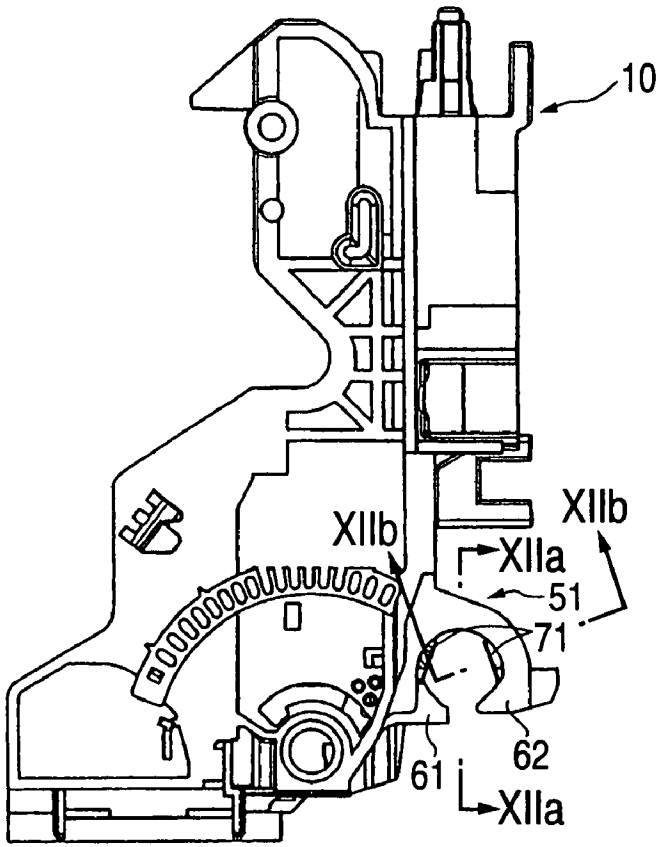
FIG. 10B is a right side view thereof.
Figure 10A:
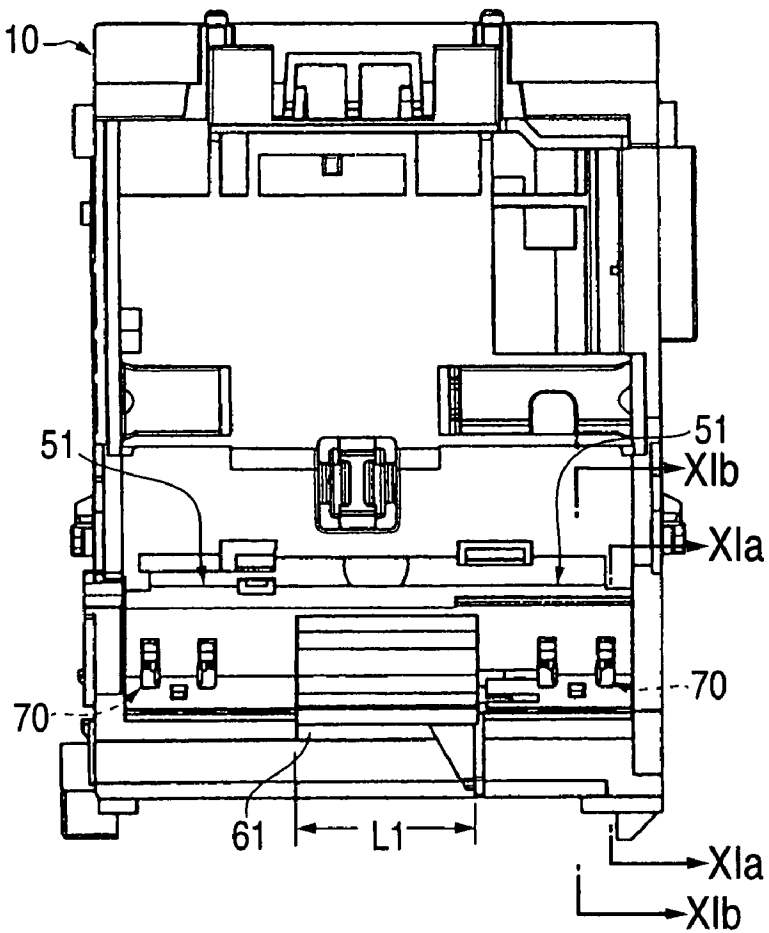
FIG. 10A is an back view of the carriage in which the bearing portions have been attached to the support portions.
Figure 11A:
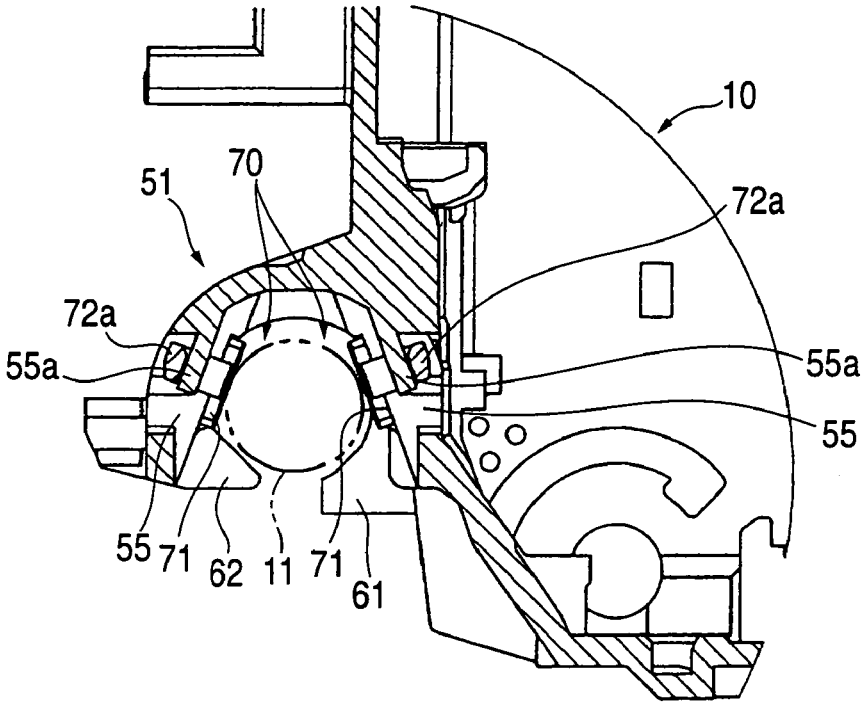
FIG. 11A is an enlarged sectional view taken on line XIa-XIa in FIG. 10A.
Figure 11B:
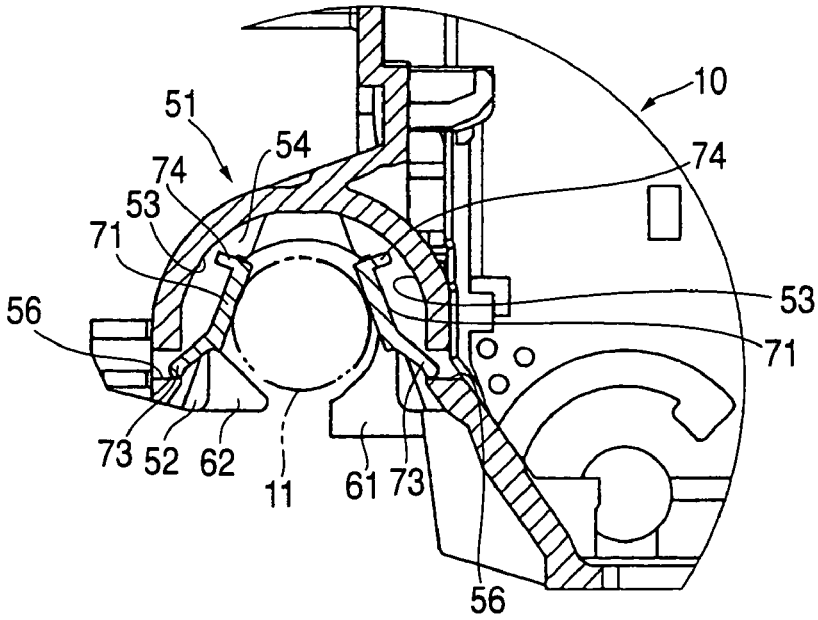
FIG. 11B is an enlarged sectional view taken on line XIb-XIb in FIG. 10B.
Figure 12A:
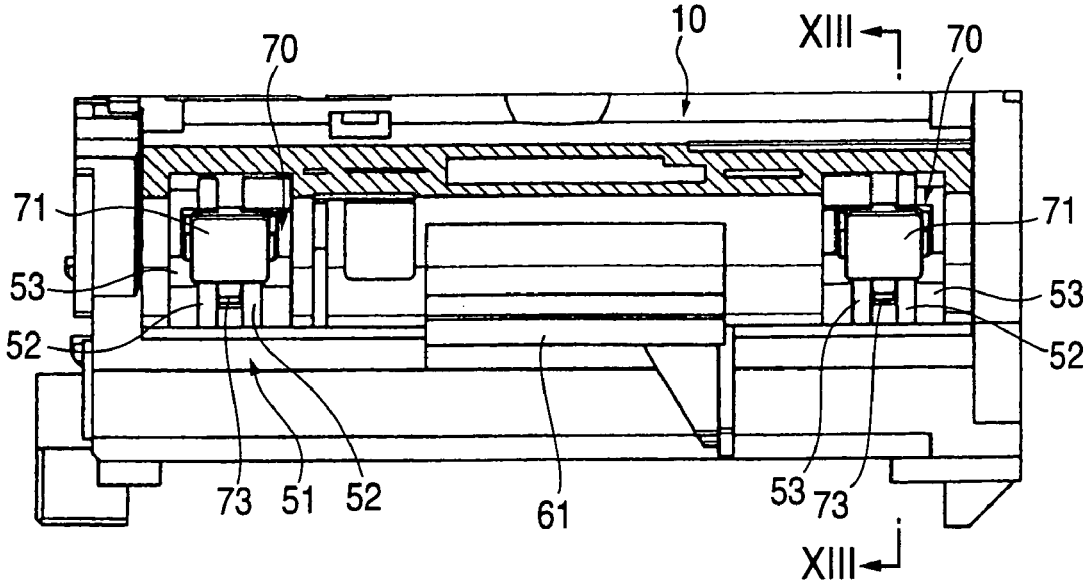
FIG. 12A is an enlarged sectional view taken on line XIIa-XIIa in FIG. 10A.
Figure 12B:
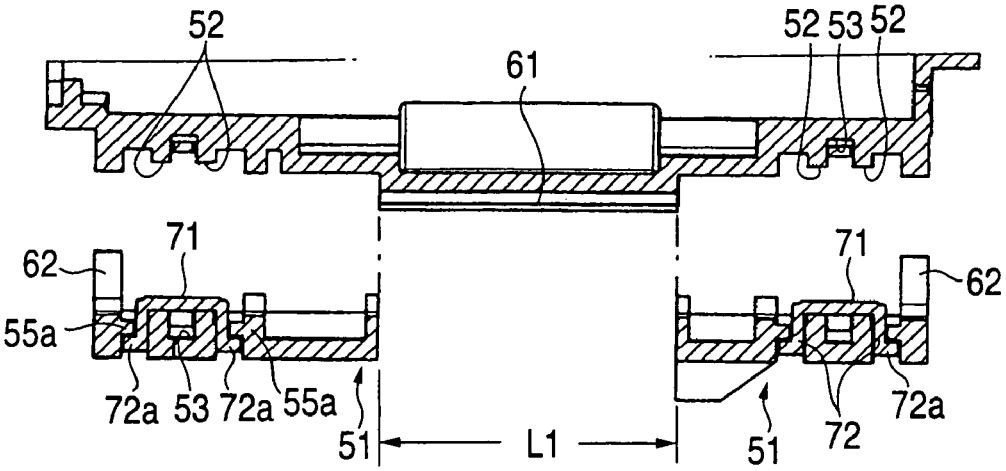
FIG. 12B is an enlarged sectional view taken on line XIIb-XIIb in FIG. 10B.

Each pair of the support surfaces 52 are formed into two parallel lines with a concave groove 53 put therebetween, so as to extend to a downward opening portion (lower end) of the support portion 51 (see FIGS. 7, 9 and 11B). A positioning stopper protrusion 54 is provided in the upper end of each support surface 52. Of the sides of the bearing portion 71, one having the guide piece 74 abuts at its edge against the stopper protrusion 54. When the bearing portion 71 is made to slide with its back surface on the support surface 52, the guide piece 74 is fitted into the concave groove 53 so as to guide the bearing portion 71 while preventing the bearing portion 71 from tilting (see FIG. 11B).

A pair of long groove-like first fitting portions 55 are provided in the support portion 51 so as to extend along the opposite outer sides of the two support surfaces 52 and penetrate the plate thickness of the support portion 51. The pair of mounting feet 72 are fitted into the pair of first fitting portions 55 movably in the longitudinal direction thereof. In addition, engagement protrusion portions 55*a* with which the lock claws 72*a* of the mounting feet 72 can engage are provided in parts of the first fitting portions 55 respectively (see FIGS. 7, 9 and 11A).

In addition, a second fitting portion 56 is provided in each concave groove 53. The front end of the positioning foot 73 in the bearing unit 70 is fitted into the second fitting portion 56 so as to prevent the positioning foot 73 from moving (see FIGS. 7, 9 and 11B).

In the aforementioned configuration, each bearing unit 70 is attached to each support portion 51 as shown in FIG. 9. That is, the carriage 10 is turned upside down (the open side of the support portion 51 looks upward). In this state, the worker picks up a portion of the positioning foot 73 in the bearing unit 70 and makes the positioning foot 73 approach the inner surface of the support portion 51 so as to insert the guide piece 74 into the concave groove 53. Thus, the back surface of the flat plate portion of the bearing portion 71 is brought into contact with the two support surfaces 52, and the pair of mounting feet 72 are inserted into the pair of first fitting portions 55 (see the arrow A direction in FIG. 9).

Next, when the bearing portion 71 is pushed by a finger so as to move sliding downward on the support surfaces 52, the lock claws 72*a* of the pair of mounting feet 72 engage with the engagement protrusion portions 55*a*. Then, the front end portion (free end portion) of the positioning foot 73 is fitted into the second fitting portion 56 in the position where the side of the bearing portion 71 provided with the guide piece 74 abuts against the stopper protrusions 54 so as not to move more deeply. Thus, the bearing unit 70 becomes incapable of falling off (see FIGS. 11A and 11B).

In this state, as shown in FIG. 13, the contained angle θ (which is set to be in a range of from 35 degrees to 40 degrees in this embodiment) between the flat plate surfaces 71*a* and 71*a* of the pair of bearing units 71 is equal to the contained angle θ between the support surfaces 52.

Incidentally, the bearing unit 70 is removed as follows. That is, a jig or the like is inserted to the second fitting portion 56 from the outer surface side of the support portion 51, so as to push the front end portion of the positioning foot 73. In addition, jigs or the like are inserted into the first fitting portions 55 so as to remove the lock claws 72*a* from the engagement protrusion portions 55*a* respectively. When a bearing unit 70 which is defective or worn down is exchanged for another bearing unit 70, the work of removing the former and attaching the latter can be achieved extremely easily by use of jigs or the like. When no jig or the like is used, it is however considerably difficult to remove the positioning foot 73 and the lock claws 72*a* from the small second fitting portion 56 and the small engagement protrusion portions 55*a* respectively. Accordingly, in normal use, there is no fear that the bearing unit 70 falls off easily from the support portion 51.

When the guide shaft 11 is inserted axially from one side (outside one of the support portions 51) of the carriage 10, the flat plate surfaces 71*a* of the bearing portions 71 of the pair of bearing units 70 disposed like a V-shape have linear contacts with two points in the upper region of the circumferential surface of the guide shaft 11. Then, the guide shaft 11 is supported at four points by the V-lettered shaped support surfaces 71*a* and 71*a* of two pairs of plate-shaped bearing portions 71 disposed at a distance from each other in the left/right direction of the carriage 10. Accordingly, the carriage 10 can move sliding on the guide shaft 11 without rattling.

The support surfaces 52 formed into a V-lettered shape in side view of the carriage 10 in each support portion 51 can be molded together with the insert molding of the body of the carriage 10. Accordingly, the contained angle θ of the V-lettered shape can be formed correctly and accurately following its designed. In addition, the paired support surfaces 52 separated at a distance from each other in the axial direction of the guide shaft 11 can be formed on one and the same plane. On the other hand, also in molding of the bearing units 70, the plate thickness or the flatness of the flat plate portions of the bearing portions 71 can be controlled easily, and the rate of occurrence of errors in molding can be suppressed to be very low. Accordingly, there is no fear that the carriage 10 is out of attachment posture or out of height position with respect to the guide shaft 11.

Figure 15A:
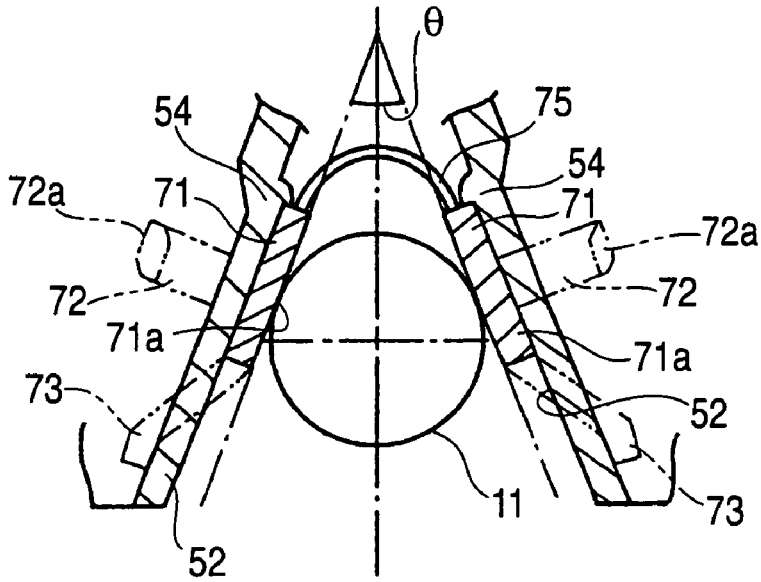
FIG. 15A is an enlarged side sectional view of bearing units on a support portion according to a second embodiment.
Figure 15B:
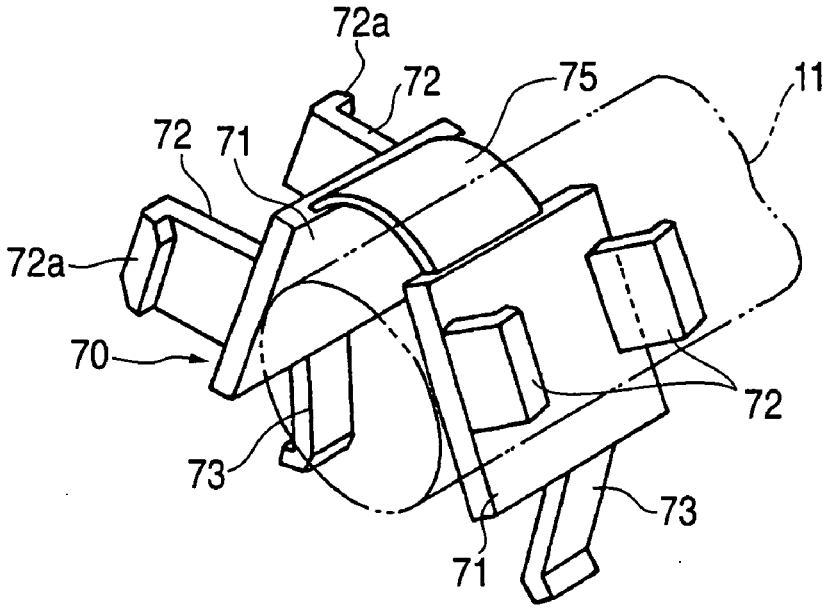
FIG. 15B is a perspective view of the bearing units.

FIGS. 15A and 15B show a second embodiment of a bearing unit 70. This embodiment has the same configuration as that in the first embodiment, except that a pair of bearing portions 71 to be disposed in a V-lettered shape on the circumferential surface of the guide shaft 11 are linked at their one sides (at their one sides to be located on the deep side of the inner surface of the support portion 51) with each other through a link piece 75 having flexibility. Parts the same in configuration as those in the first embodiment are designated by the same reference numerals correspondingly, and detailed description thereof will be omitted.

According to the configuration of the second embodiment, the two bearing portions 71 may be concurrently disposed and attached to the aforementioned support surfaces 52 and 52 having a V-lettered shape. Incidentally, due to the link piece 75, there is no fear that the two bearing portions 71 are separated. Accordingly, the positioning foot 73 may be omitted. Even in such a case, as long as each flat-plate-shaped bearing portion 71 is put between the circumferential surface of the guide shaft 11 and its corresponding support surface 52, there is no fear that the bearing unit 70 falls off. In addition, even when each bearing portion 71 moves slipping in the longitudinal direction of the support surface 52 while the back surface of the bearing portion 71 abuts against the support surface 52, there is no change in the attachment posture or the height position of the carriage 10 with respect to the guide shaft 11. This is because such a change occurs only when the plate thickness of the flat plate portion of the bearing portion 71 changes partially or totally.

Incidentally, a V-lettered shaped bearing unit 70 may be configured by the two bearing portions 71 being integrally formed, as long as the contained angle θ between the bearing portions 71 is ensured.

Assuming that the carriage 10 to which any one of the aforementioned embodiments has been applied is stopped in the maintenance portion 27, and the suction caps 28*a* are moved up to cover the nozzle portions 15*a* of the recording head 15 mounted on the carriage 10. Even in such a case, the carriage 10 can be surely prevented from falling off from the guide shaft 11 due to the up-thrust of the suction caps 28*a* because the first retaining portion 61 and the two second retaining portions 62 surround the lower region of the guide shaft 11 oppositely. In addition, the posture of the carriage 10 is stabilized at the time of capping and at the time of purging because the first retaining portion 61 and the two second retaining portions 62 are disposed to sandwich a pair of bearing units 70 from their opposite, left and right sides.

Even when the body of the multifunctional apparatus 1 is tilted, the first retaining portion 61 and the two second retaining portions 62 can prevent the carriage 10 from falling off from the guide shaft 11 accidentally.

In a contingency such as the fall of the multifunctional apparatus 1, the carriage 10 has to withstand a large external force acting to detach the carriage 10 from the guide shaft 11. To this end, it is preferable that at least the length (in the axial direction of the guide shaft 11) of the first retaining portion 61 is increased to secure strength. In that case, the first retaining portion 61 may be formed continuously or intermittently in the longitudinal direction of the guide shaft 11. When the positions where the first retaining portion 61 and each second retaining portion 62 are set to be separated from each other in the axial direction of the guide shaft 11, the operation of preventing the carriage 10 from falling off from the guide shaft 11 can be further enhanced.

In addition, a pair of support portions 51 are disposed at a distance from each other in the axial direction of the guide shaft 11, and the first retaining portion 61 and the two second retaining portions 62 are also disposed at a distance from each other in the axial direction of the guide shaft 11 so as to put the pair of support portions 51 therebetween. Accordingly, the portions for supporting the carriage 10 on the guide shaft 11 are stabilized, and a mold for injection-molding the carriage 10 can be produced easily.

Further, the open portion of each support portion 51 is formed into a substantially semicircular shape in section and to be larger on the open side. Accordingly, the accuracy in molding each support portion 51 and particularly a pair of support surfaces 52 by use of the mold can be improved, and the support portion can be also molded easily.

With the configuration described above, there occurs no fluctuation in the gap G1 between the face surface of the nozzle portions 15*a* of the recording head 15 and the top (surface which is the path the sheet P as a recording medium passes through) of the platen 25 even when printing is performed with the carriage 10 being moved forward and backward in the main scanning direction along the guide shaft 11. Due to the changeover mechanism 30, there is no fear that the posture of the carriage 10 becomes imprecise when the carriage 10 is displaced rotating around the guide shaft 11 so as to change the gap G1.

When the bearing units 70 are designed to be attached to the support portions 51 of the carriage 10 after installation of the apparatus, the material of the bearing units 70 can be made independent of that of the carriage 10. When at least the bearing portion 71 of each bearing unit 70 is formed out of a synthetic resin material low in frictional coefficient and resistant to abrasion, it is possible to avoid a disadvantage that the guide shaft 11 wears down to cause fluctuation of the sliding surface between the guide shaft 11 and the bearing portion 71, and it is possible to improve the durability of the multifunctional apparatus 1.

When the suction caps 28*a* move up at the time of maintenance or the like, the carriage 10 is pushed to move up. In this event, the bearing portions 71 are lifted up from the guide shaft 11 so that the top of the first retaining portion 61 and the tops of second retaining portions 62 abut against the lower circumferential surface of the guide shaft 11. Accordingly, even in this event, the carriage 10 is positioned stably. Thus, the maintenance is performed stably.

Incidentally, in a case where it is unnecessary to rotate and displace the carriage 10 around the guide shaft 11, it is unnecessary to make the guide shaft 11 circular in section. The guide shaft 11 may be a solid or pipe-like guide shaft having a noncircular shape in section, such as a quadrangular shape in section, a polygonal shape in section or an elliptic shape in section.

The multifunctional apparatus 1, which is described in the first and the second embodiments, is configured to be usable as a serial-type image scanner by replacing the recording head 15 with a scanning head including at least one scanning device that scans the image formed on the sheet P and outputs an electronic signal.

When using the multifunctional apparatus 1 as an image scanner, the recording head 15 is removed from the carriage 10 and the scanning head is mounted onto the carriage 10. Thereafter, the sheet P is conveyed while moving the carriage 10 in a direction orthogonal to the conveyance direction of the sheet P, and the image formed on the sheet P is scanned by the scanning head.

Incidentally, the multifunctional apparatus 1 may be configured so that the recording head 15 is non-replaceable with the scanning head, or be configured so that only the scanning head is to be mounted on the carriage 10 and made non-replaceable with the recording head 15.

The present invention described above with a preferred embodiments, is applicable not only to the aforementioned multifunctional apparatus but also to printers, copying machines, and carriage-mounting type image scanners.

As described above, according to a first configuration of the invention, there is provided an image forming apparatus including: a recording head that forms an image onto a recording medium; a guide shaft disposed to extend in a direction orthogonal to a conveyance direction of the recording medium; a carriage on which the recording head is mounted and includes a support portion formed integrally with the carriage; and a bearing unit attached to an inner surface of the support portion and allows the carriage to be moved along the guide shaft, and includes plate-shaped bearing portions that are disposed to have a contained angle that allows the bearing portions to contact with a circumferential surface of the guide shaft at two points.

According to the first configuration of the invention in which a carriage mounted with a recording head is designed to be movable forward and backward with respect to a guide shaft disposed to extend in a direction crossing a conveyance direction of a recording medium, bearing units having plate-shaped bearing portions are attached to an inner surface of a support portion formed integrally with the carriage. Accordingly, in comparison with background-art apparatus in which bearing units are formed integrally with support portions by molding or the like in advance, bearing units are attached after installation of apparatus according to the inventive configuration so that only defective bearing units having attachment errors or having worn due to long-term use can be replaced easily. In addition, the bearing units can be formed out of a material different from a material of the carriage itself. Accordingly, there is an effect that the abrasion of the guide shaft and the sliding resistance of the carriage can be reduced extremely easily.

In addition, the bearing portions are disposed so that a contained angle therebetween is regulated to allow the bearing portions to contact with a circumferential surface of the guide shaft at two points. Accordingly, there is an advantage that the bearing portions can be attached more easily than in the background-art apparatus in which bearing units having bearing holes each formed into a piriform shape are planted in a carriage or U-letter shaped bearing portions are produced by injection molding.

According to a second configuration of the invention, in addition to the first configuration, at least a pair of bearing units are provided as the bearing unit.

According to a third configuration of the invention, each of the bearing units includes one of the plate-shaped bearing portions, and wherein the pair of the bearing units are disposed to sandwich the circumferential surface of the guide shaft between flat plate portions of the bearing portions thereof.

According to the third configuration of the invention, each of the bearing units has one of the plate-shaped bearing portions, and a pair of the bearing units are disposed to sandwich the circumferential surface of the guide shaft between flat plate portions of the bearing portions thereof.

In addition to the advantages according to the first configuration of the invention, there is an advantage as follows. That is, since the plate thickness of the flat plate portion of each bearing portion can be controlled easily. Therefore, a mass of uniform and accurate bearing units each having a reduced error in manufacturing its bearing portion can be manufactured so that the yield rate of products becomes high. By use of the bearing units, a carriage having accurate bearing portions can be produced easily.

According to a fourth configuration of the invention, in addition to the first configuration, the support portion has a pair of support surfaces provided in the inner surfaces for supporting back surfaces of the bearing portions, and wherein the pair of support surfaces are configured to have a contained angle therebetween that corresponds to the contained angle between the bearing portions.

According to the fourth configuration, a pair of support surfaces for supporting back surfaces of flat plates in the bearing portions respectively are provided in the inner surface of the support portion, and formed so that a contained angle between the pair of support surfaces is equal to the contained angle between the bearing portions.

With such a configuration, in addition to the effects according to the first or second configuration of the invention, there is an effect as follows. That is, if the contained angle between the pair of support surfaces is formed correctly when the carriage is manufactured, the attachment posture of the carriage with respect to the circumferential surface of the guide shaft, the relationship in height therebetween, and so on, can be determined accurately only by disposing the bearing portions on the support surfaces.

According to a fifth configuration of the invention, in addition to the first configuration, the contained angle is an acute angle.

According to the fifth configuration, the contained angle is an acute angle. Accordingly, there is an advantage that the portions where the pair of plate-shaped bearing portions contact with and slide on the circumferential surface of the guide shaft at its two points can be regulated correctly.

According to a sixth configuration of the invention, in addition to the first configuration, the support portion includes a first fitting portion, and wherein the bearing units further includes a mounting foot that is fitted to the first fitting portion.

According to the sixth configuration, the bearing units include mounting feet so that the mounting feet can be fitted to first fitting portions in the support portion, respectively. Accordingly, there is an advantage that the bearing units can be surely and firmly attached to the first fitting portions in the supply portion, respectively.

According to a seventh configuration of the invention, in addition to the sixth configuration, the mounting foot is provided to be detachable from the first fitting portion.

According to the seventh configuration, the mounting feet are made detachable from the first fitting portions. Accordingly, there is an advantage that the work of replacing the bearing units becomes easy.

According to an eighth configuration of the invention, in addition to the sixth configuration, the support portion further includes a second fitting portion, and wherein the bearing units further include a positioning foot that is fitted to the second fitting portion.

According to the eighth configuration, the bearing units further include positioning feet so that the positioning feet can be fitted to second fitting portions in the support portion, respectively. Accordingly, there is an advantage that the attachment posture and the attachment position of each bearing unit can be retained surely in the state where the bearing unit has been attached to the support portion.

According to a ninth configuration of the invention, in addition to the eighth configuration, the mounting foot is provided to be detachable from the second fitting portion.

According to the ninth configuration of the invention, the mounting feet are made detachable from the first fitting portions. Accordingly, there is an advantage that the work of replacing the bearing units becomes easy.

According to a tenth configuration of the invention, in addition to the first configuration, the bearing portions are made of synthetic resin having characteristic low in frictional coefficient and resistant to abrasion.

According to the tenth configuration of the invention, at least the flat plates are formed out of a synthetic resin material low in frictional coefficient and resistant to abrasion. Accordingly, there is an advantage that the durability of the bearing units and hence the durability of the carriage are improved, and the guide shaft does not wear out, so that the attachment posture and the height of the carriage with respect to the guide shaft can be retained for a long time.

According to an eleventh configuration of the invention, in addition to the tenth configuration, the bearing portions are made of polyacetal resin.

According to a twelfth configuration of the invention, in addition to the fifth configuration, the contained angle between the bearing portions is set to be in a range of from 35 degrees to 40 degrees.

According to a thirteenth configuration of the invention, in addition to the first configuration, the carriage further includes a retaining portion that is formed integrally with the carriage and prevents the carriage from falling off from the guide shaft from an opposite side to a position where the bearing units are provided.

According to a fourteenth configuration of the invention, in addition to the thirteenth configuration, the support portion and the retaining portion are formed at different positions along an axis of the guide shaft, respectively.

According to the fourteenth configuration, the support portion and the retaining portions can be formed integrally and extremely easily when the carriage is manufactured. In addition, the dimensional accuracy in the shapes and forms of the support portion and the retaining portions can be improved.

Further, the carriage can be surely prevented from falling off from the guide shaft due to an external force acting on the carriage.

According to a fifteenth configuration of the invention, in addition to the fourteenth configuration, a pair of support portions are provided as the support portion at a predetermined distance from each other along the axis of the guide shaft, and wherein the retaining portion is provided at a position between the pair of support portions.

According to the fifteenth configuration, there is an advantage that the support portions for the bearings can be formed at a distance from each other in the moving direction of the carriage, so that the posture of the carriage supported on the guide shaft can be set more accurately.

According to a sixteenth configuration of the invention, in addition to the fifteenth configuration, the retaining portion includes a first retaining portion and second retaining portions, wherein the first retaining portion is provided between the pair of support portion, and wherein the second retaining portions are provided at an outermost side of the each of the support portions.

According to the sixteenth configuration, there is an advantage that the operation of preventing the carriage from falling off from the guide shaft can be further enhanced.

According to a seventeenth configuration of the invention, in addition to the sixteenth configuration, the first retaining portion is formed along the axis of the guide shaft.

According to an eighteenth configuration of the invention, in addition to the seventeenth configuration, the first retaining portion is formed continuously along the axis of the guide shaft.

According to a nineteenth configuration of the invention, in addition to the seventeenth configuration, the first retaining portion is formed intermittently along the axis of the guide shaft.

According to the seventeenth through nineteenth configurations, the first retaining portion is formed continuously or intermittently along the axis of the guide shaft. Accordingly, there is an advantage that the carriage can withstand a large external force acting to detach the carriage from the guide shaft in a contingency such as the fall of the multifunctional apparatus.

According to a twentieth configuration of the invention, there is provided an image scanner including a scanning head that scans an image formed on a medium to be scanned; a guide shaft disposed to extend in a direction orthogonal to a conveyance direction of the medium; a carriage on which the scanning head is mounted and includes a support portion formed integrally with the carriage; and a bearing unit attached to an inner surface of the support portion and allows the carriage to be moved along the guide shaft, and includes plate-shaped bearing portions that are disposed to have a contained angle that allows the bearing portions to contact with a circumferential surface of the guide shaft at two points.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a recording head that forms an image onto a recording medium;

a guide shaft extending in a direction orthogonal to a conveyance direction of the recording medium;

a carriage on which the recording head is mounted and including a support portion formed integrally with the carriage; and a bearing unit including a pair of plate-shaped bearing portions, the bearing unit being discrete from the support portion and detachably attached to a concave inner surface of the support portion to allow the carriage to be moved along the guide shaft, wherein each of the plate-shaped bearing portions includes a flat surface that contacts a circumferential surface of the guide shaft and a back surface that is opposite to the flat surface, wherein the carriage includes a pair of support surfaces extending from the concave inner surface for supporting the back surface of the plate-shaped bearing portions, and forming a contained angle that allows the flat surfaces of the plate-shaped portions to contact with the circumferential surface of the guide shaft at two points, and wherein the pair of support surfaces have a contained angle therebetween corresponding to the contained angle between the bearing portions.

2. The image forming apparatus according to claim 1, wherein the bearing unit includes a first bearing unit and a second bearing unit.

3. The image forming apparatus according to claim 2, wherein the first bearing unit comprises a first one of the plate-shaped bearing portions and the second bearing unit comprises a second one of the plate-shaped bearing portions, and wherein the first bearing unit and the second bearing unit are disposed to sandwich the circumferential surface of the guide shaft between the first one of the plate-shaped bearing portions and the second one of the plate-shaped bearing portions.

4. The image forming apparatus according to claim 1, wherein the contained angle is an acute angle.

5. The image forming apparatus according to claim 4, wherein the contained angle between the bearing portions is set to be in a range of from 35 degrees to 40 degrees.

6. The image forming apparatus according to claim 1, wherein the support portion includes a first fitting portion, and wherein the bearing unit further includes a mounting foot that is fitted to the first fitting portion.

7. The image forming apparatus according to claim 6, wherein the mounting foot is provided to be detachable from the first fitting portion.

8. The image forming apparatus according to claim 6, wherein the support portion further includes a second fitting portion, and wherein the bearing unit further includes a positioning foot that is fitted to the second fitting portion.

9. The image forming apparatus according to claim 8, wherein the mounting foot is provided to be detachable from the second fitting portion.

10. The image forming apparatus according to claim 1, wherein the carriage further includes a retaining portion that is formed integrally with the carriage and prevents the carriage from falling off from the guide shaft from an opposite side to a position where the bearing units are provided.

11. The image forming apparatus according to claim 10, wherein the support portion and the retaining portion are formed at different positions along an axis of the guide shaft.

12. The image forming apparatus according to claim 11, wherein a pair of support portions are provided as the support portion at a predetermined distance from each other along the axis of the guide shaft, and wherein the retaining portion is provided at a position between the pair of support portions.

13. The image forming apparatus according to claim 12, wherein the retaining portion includes a first retaining portion and second retaining portions, wherein the first retaining portion is provided between the pair of support portions, and wherein the second retaining portions are provided at an outermost side of each of the support portions.

14. The image forming apparatus according to claim 13, wherein the first retaining portion is formed along the axis of the guide shaft.

15. The image forming apparatus according to claim 14, wherein the first retaining portion is formed continuously along the axis of the guide shaft.

16. The image forming apparatus according to claim 14, wherein the first retaining portion is formed intermittently along the axis of the guide shaft.

17. The image forming apparatus according to claim 1, wherein the support member and the bearing portions are made of different material.

18. The image forming apparatus according to claim 17, wherein the bearing portions are made of synthetic resin having a characteristic low in frictional coefficient and resistant to abrasion.

19. The image forming apparatus according to claim 18, wherein the bearing portions are made of polyacetal resin.

20. The image forming apparatus according to claim 1, wherein the support portion includes an opening opposite to the concave inner surface in a radial direction of the guide shaft.

21. The image forming apparatus according to claim 20, wherein the bearing unit is attachable to the concave inner surface through the opening.

22. An image scanner comprising:

a scanning head that scans an image formed on a medium to be scanned;

a guide shaft extending in a direction orthogonal to a conveyance direction of the medium;

a carriage on which the scanning head is mounted and including a support portion formed integrally with the carriage; and a bearing unit including a pair of plate-shaped bearing portions, the bearing unit being discrete from the support portion and detachably attached to a concave inner surface of the support portion to allow the carriage to be moved along the guide shaft, wherein each of the plate-shaped bearing portions includes a flat surface that contacts a circumferential surface of the guide shaft and a back surface that is opposite to the flat surface, wherein the carriage includes a pair of support surfaces extending from the concave inner surface for supporting the back surface of the plate-shaped bearing portions, and forming a contained angle that allows the flat surfaces of the plate-shaped portions to contact with the circumferential surface of the guide shaft at two points, and wherein the pair of support surfaces have a contained angle therebetween corresponding to the contained angle between the bearing portions.

23. The image scanner according to claim 22, wherein the contained angle is an acute angle.

24. The image scanner according to claim 22, wherein the support portion includes a first fitting portion, and wherein the bearing units further include a mounting foot that is fitted to the first fitting portion.

25. The image scanner according to claim 24, wherein the mounting foot is provided to be detachable from the first fitting portion.

26. The image scanner according to claim 24, wherein the support portion further includes a second fitting portion, and wherein the bearing unit further includes a positioning foot that is fitted to the second fitting portion.

27. The image scanner according to claim 26, wherein the mounting foot is provided to be detachable from the second fitting portion.

28. The image scanner according to claim 22, wherein the support member and the bearing portions are made of different material.

29. The image scanner according to claim 28, wherein the bearing portions are made of synthetic resin having a characteristic low in frictional coefficient and resistant to abrasion.

30. The image scanner according to claim 29, wherein the bearing portions are made of polyacetal resin.

* * * * *